US006616084B1

(12) United States Patent
Sitzmann

(10) Patent No.: US 6,616,084 B1
(45) Date of Patent: Sep. 9, 2003

(54) WINDING METHOD AND DEVICE FOR MACHINES FOR PROCESSING PRINTING MATERIALS

(75) Inventor: Bernd Sitzmann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/677,322

(22) Filed: Sep. 29, 2000

(30) Foreign Application Priority Data

Sep. 29, 1999 (DE) ..... 199 46 618

(51) Int. Cl.[7] ..... B65H 18/08
(52) U.S. Cl. ..... 242/534
(58) Field of Search ..... 242/534, 563

(56) References Cited

U.S. PATENT DOCUMENTS 4,135,448 A 1/1979 Moestue
5,105,740 A 4/1992 Loos et al.
5,566,906 A * 10/1996 Kamada et al. ..... 242/563
5,894,800 A 4/1999 Bär et al.

FOREIGN PATENT DOCUMENTS

DE 2538105 * 11/1977
DE 3909119 * 9/1990
DE 195 43 518 * 5/1997
EP 0552 856 * 7/1993

* cited by examiner

*Primary Examiner*—John Q. Nguyen
(74) *Attorney, Agent, or Firm*—Laurence A. Greenberg; Werner H. Stemer; Gregory L. Mayback

(57) ABSTRACT

A method of winding a web band in a machine for processing printing materials, including controlling the winding as a function of a diameter of a roll formed by the web band, as the diameter changes during the winding, includes determining, by a first sensor fastened to a frame of the machine, the position of a peripheral surface of the roll relative to the frame of the machine, and determining, by a second sensor fastened to the frame of the machine, the position of one of a center of the roll and of a peripheral surface of a spindle carrying the roll, relative to the frame of the machine; a winding device for performing the method; and a printing-material processing machine, such as a printing press, having the winding device.

15 Claims, 5 Drawing Sheets

WINDING METHOD AND DEVICE FOR MACHINES FOR PROCESSING PRINTING MATERIALS

BACKGROUND OF THE INVENTION

Field of the Invention

The invention relates to a method of winding a web in a machine for processing printing materials and, more particularly, includes controlling the winding of the web into a roll as a function of the diameter of the roll being formed by the web, as the diameter changes during the winding, and a winding device for machines for processing printing materials, including equipment for winding a web up into a roll, and a first feeler for monitoring the diameter of the web, as the diameter changes during the winding of the web into the roll.

In order to clean rollers or cylinders in printing machines, washing devices are provided which are constructed as slide-in or insert elements having cleaning cloths which are unwindable from supply rolls.

Such a washing device is described in the published German Patent Document DE 39 09 119 A1. When it is being inserted or slid into the printing machine, it is automatically couplable mechanically to a roll checking device affixed to the machine.

Strictly speaking, although a proximity switch of the roll checking device is arranged so as to be affixed to the machine, a sensing plate thereof resting on the roll of cloth is not. The only sensing plate of the roll checking device is arranged on the slide-in or insert element.

The washing device described in the aforementioned published German patent document, however, is practically not usable as a reserve washing device for optional or selective insertion into different printing machines. If the washing device, after being removed from a printing unit and after the dirty cleaning cloth thereof has been replaced by a fresh cleaning cloth, were to be inserted into a different printing unit, complicated adjustments would be required each time.

The published German Patent Document DE 29 507 134 U1 makes reference to this inadequacy. A device described therein for washing cylinders or rollers should certainly be exchangeable desirably between the individual printing units, but nevertheless, the device is not easy to handle and is susceptible to failure. The entire cloth checking mechanism and a sensing tongue belonging to the latter are mounted on a side part removable from the printing machine and are not affixed to the machine. The sensing tongue is a hindrance when the cleaning cloth is being replaced outside the printing machine and can, as a result of careless handling, be damaged, which makes precise checking of the roll impossible.

In the published German Patent Document DE 42 33 953 A1, a washing device for a printing-machine cylinder is described, which has a washing bar, and a cleaning cloth-end indicator fixed in position on the printing-machine frame and serving for generating a machine shut-off signal that is produced shortly before the end of a cleaning cloth and is generated even when the washing bar with the cleaning cloth is not in a washing position. This published German patent document does not describe specifically what type of indicator is being referenced.

In addition, the published German Patent Document DE 195 43 518 A1 describes a device for washing cylinder jacket surfaces wherein, in the operating position thereof, a supply of cloth on a supply roll is monitored by sensors which are brought into a functional position when inserted. This published document does not contain any specific statements relating to the mounting of the sensors.

SUMMARY OF THE INVENTION

It is accordingly an object of the invention to provide a method for winding up a web into a roll in a machine for processing printing materials, wherein a critical diameter of the roll is precisely determined, and to provide a device for performing the method, which has a feeler or sensor that is reliably protected against damage.

With the foregoing and other objects in view, there is therefore provided, in accordance with one aspect of the invention, a method of winding a web band in a machine for processing printing materials, including controlling the winding as a function of a diameter of a roll formed by the web band, as the diameter changes during the winding, which comprises determining, by a first sensor fastened to a frame of the machine, the position of a peripheral surface of the roll relative to the frame of the machine, and determining, by a second sensor fastened to the frame of the machine, the position, relative to the frame of the machine, of either a center of the roll or of a peripheral surface of a spindle carrying the roll.

In accordance with another mode, the method, wherein the sensors are feelers, includes, by a first feeler resting on the roll formed by the web band, monitoring the diameter of the roll formed by the web band, as the diameter changes during the winding, and interrupting the winding when the roll has reached a critical diameter, and sensorally monitoring the mutually relative positions of the first feeler and of a second feeler.

In accordance with a further mode, the method includes sensorally monitoring mutually relative angular positions of the feelers.

In accordance with another aspect of the invention, there is provided a winding device for a machine for processing printing materials, comprising a web band windable into a roll, a first feeler for monitoring a diameter of a roll being wound as the diameter changes during the winding, the first feeler being mounted affixed to a frame of the machine.

In accordance with another feature of the invention, the winding device includes a second feeler assigned to the first feeler.

In accordance with a further feature of the invention, the second feeler is mounted affixed to the frame of the machine.

In accordance with an added feature of the invention, the winding device includes a sensor assigned to the feelers for monitoring the mutually relative positions thereof.

In accordance with an additional feature of the invention, the sensor is applied to one of the feelers.

In accordance with yet another feature of the invention, the winding device includes a protective covering of the machine coupled with the first feeler via a mechanism.

In accordance with yet a further feature of the invention, the web band is a cleaning cloth.

In accordance with an additional aspect of the invention, there is provided a machine for processing printing materials having at least one winding device with at least one of the foregoing features.

In accordance with a concomitant feature of the invention, the machine for processing printing materials is a printing press having at least one winding device with at least one of the foregoing features thereof.

The method according to the invention ensures the precise determination or registration of the critical diameter of the roll, so that the web band length is optimally utilized, and the end of the web is nevertheless detected and held fast reliably.

Both when the sensors are constructed as contacting feelers, as well as when the sensors are constructed as contact-free measuring sensors, for example, as ultrasonic or infrared sensors, these sensors can be connected to an. electronic computer for evaluating a differential measurement.

The second sensor transmits to the computer a first signal corresponding either to a distance of the center of the roll or to a distance of the peripheral surface of the roll, from the frame, and the first sensor transmits to the computer a signal corresponding to the distance of the peripheral surface of the roll from the frame.

From the two signals, the computer automatically calculates a differential signal which is proportional to the radius of the roll, which changes during the winding, and is therefore proportional to the length of the web band wound up on the roll.

This web-band length can be indicated to the operator via an indicating device connected to the computer, for the purpose of making-ready or preparing the replacement of the web band.

The computer is capable of stopping a drive effecting the rotation of the roll, so that the winding operation is interrupted when the differential signal has fallen below a specific value.

In a preferred mode of the method according to the invention, the sensors which are used are feelers contacting the measurement locations.

The method can be implemented effectively with the winding device according to the invention. The beneficial factor in the winding device is that the web band thereof and an unwinding- spindle, spool or roller from which the web band is unwound, can be removed without removing the first feeler from the printing-material processing machine. During the replacement of the web band, the first feeler can remain in the processing machine, where it is protected against damage and is not a hindrance during the replacement of the web band.

In an embodiment of the winding device according to the invention, which is advantageous with regard to the use of the winding device as a reserve device provided for use in various machines which process printing materials or in various components of a machine that processes printing materials, the first feeler has a second feeler assigned thereto.

In addition, this embodiment is advantageous with regard to implementing the method according to the invention.

The winding device having a second feeler in addition to the first feeler is preferably constructed in a manner corresponding to that of the winding device having only the one feeler which is mounted in a fixed location on a frame of the machine, and can also be a winding device constructed differently therefrom. The presence of two feelers also results in advantages with regard to the precise presetting of the first feeler by the second feeler without requiring adjusting work to be performed manually and without excessive time-consumption, even in the case of winding devices having a first feeler that is not mounted in a fixed position on the frame of the machine.

Other features which are considered as characteristic for the invention are set forth in the appended claims.

Although the invention is illustrated and described herein as a winding method and device for machines for process printing materials, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
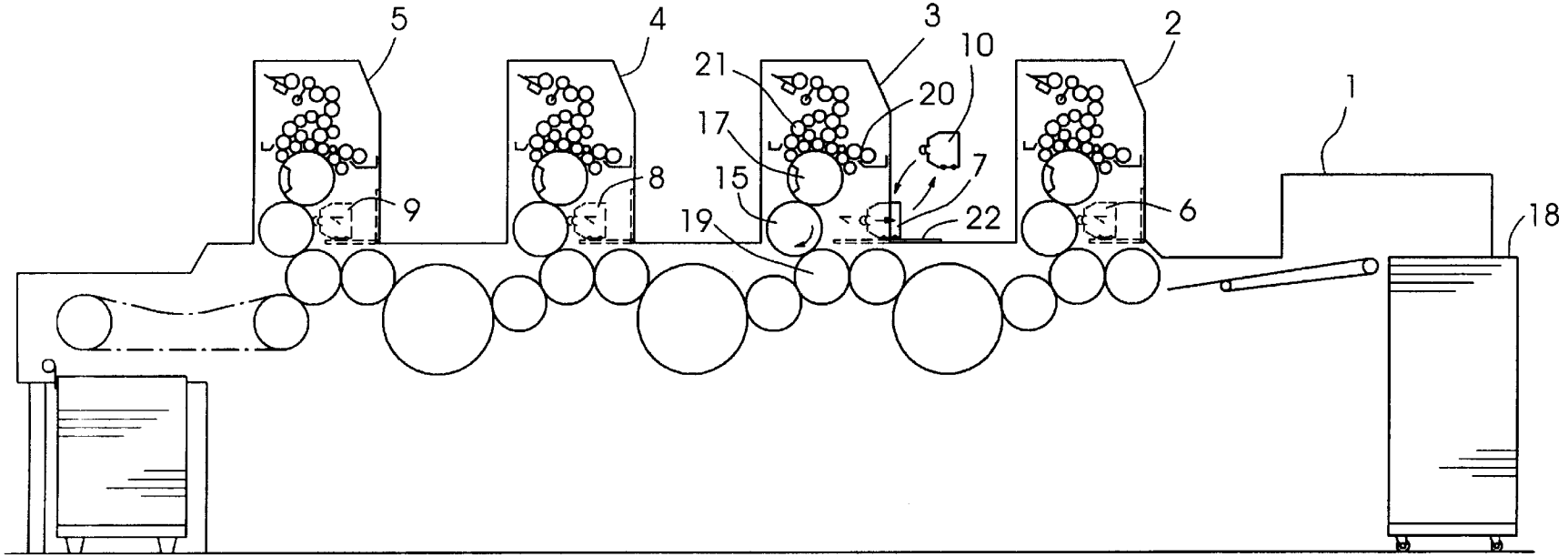
FIG. 1 is a diagrammatic side elevational view of a machine for processing printing materials, which includes a number of winding devices.

Referring now to the drawings and, first, particularly to FIG. 1 thereof, there is shown therein a printing-material processing machine 1 in the form of a printing press, especially a rotary printing press, having at least one printing unit 2 to 5, especially at least one offset printing unit. At least one winding device 6 to 10 is included in or belongs to the machine 1 and is provided with a web band 11, (note FIG. 2, for example) which is wound from a sleeve-like unwinding roller, spool or spindle 12 onto a sleeve-like winding roller, spool or spindle 13, for which purpose the winding roller 13 is rotated in the direction of the arrow associated therewith in FIG. 2, by an electric motor 14.

The winding device 7 is a cleaning device, the web band 11 wound thereon and serving as a cleaning band for cleaning a rotating cylinder 15 of the machine 1 is, from time to time, pressed against the peripheral surface of the cylinder 15 by a pressure bar 16. The web band 11 is formed of an absorbent material, for example a cloth-like fabric or a fibrous fleece material, and is impregnatable by a washing liquid.

The cylinder 15 is a blanket cylinder of the printing unit 3 which, during printing, transfers the printing ink from a printing-plate cylinder 17 to a sheet printing material 18, which rests on an impression cylinder 19 during the process. The printing-plate cylinder 17 is dampened during printing by a dampening unit 20 and is inked by an inking unit 21.

The winding device 7 is insertable on a guide through a window formed in the outer casing or panelling of the machine 1 onto the cylinder 15 and is again withdrawable from the machine 1 therethrough. The guide is formed to some extent by a flap which, as a protective covering 22, serves for opening and closing the machine 1 and the window, respectively. The constructive combination of the guide with the protective covering 22 is advantageous with regard to minimizing the actions to be carried out by the operator. The displacement of the guide, which projects out of the machine 1 during the insertion of the winding device 7 into the machine 1, and the closing of the protective covering 22 are performed by the same action. When the flap is pivoted downwardly for the purpose of opening the protective covering 22, the bar-like winding device 7 can be placed onto the upwardly directed inner side of the flap and displaced on at least one rail on the inner side. This is particularly advantageous in the case of a large and heavy winding device 7, which would otherwise be very unwieldy for the operator.

Figure 2:
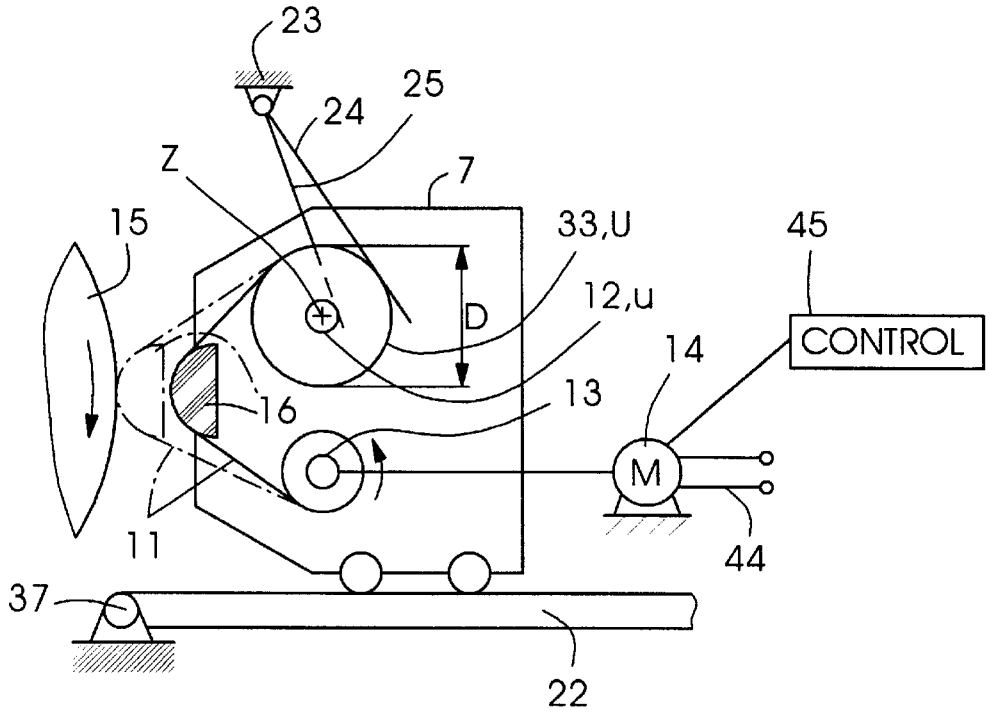
FIG. 2 is an enlarged fragmentary view of FIG. 1 showing one of the winding devices in greater detail.
Figure 3:
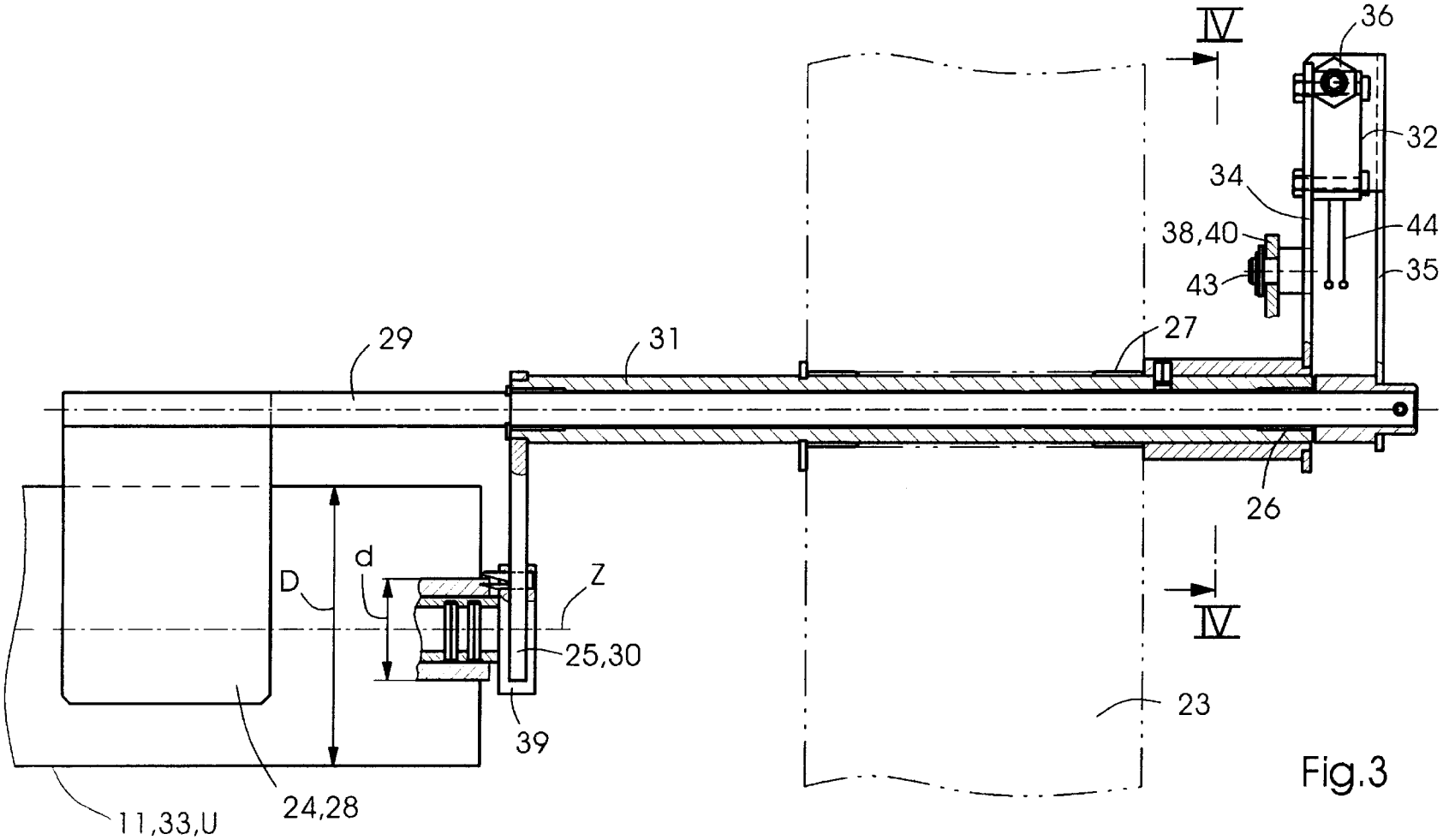
FIG. 3 is a plan view, partly in section, of parts of the winding device.

As shown in FIG. 2, on a frame 23 of the machine 1, for example, a side wall of the printing unit 3, a first feeler 24 and a second feeler 25 are fixed so that they are movable relative to one another. According to FIG. 3, the first feeler 24 is mounted so that it is pivotable about a first rotary joint 26, and the second feeler 25 is mounted so that it is pivotable about a second rotary joint 27, the rotary joints 26 and 27 being arranged coaxially with one another. The mutually coaxial mounting of the feelers 24 and 25 advantageously permits them to be integrated into the machine 1 in a very small space. The first feeler 21 includes a first lever arm 28 and a shaft 29, to which the first lever arm 28 is fastened. The second feeler 25 includes a second lever arm 30 and a hollow shaft 31, to which the second lever arm 30 is fastened. The hollow shaft 31 is rotatably mounted in the frame 23 via the second rotary joint 27, serving as the joint journal therefor. The shaft 29 is rotatably mounted in the hollow shaft 31 via the first rotary joint 26, serving as the shaft journal therefor, the shaft 29 being passed through the hollow shaft 31 and projecting at both ends thereof from the hollow shaft 31.

Figure 4:
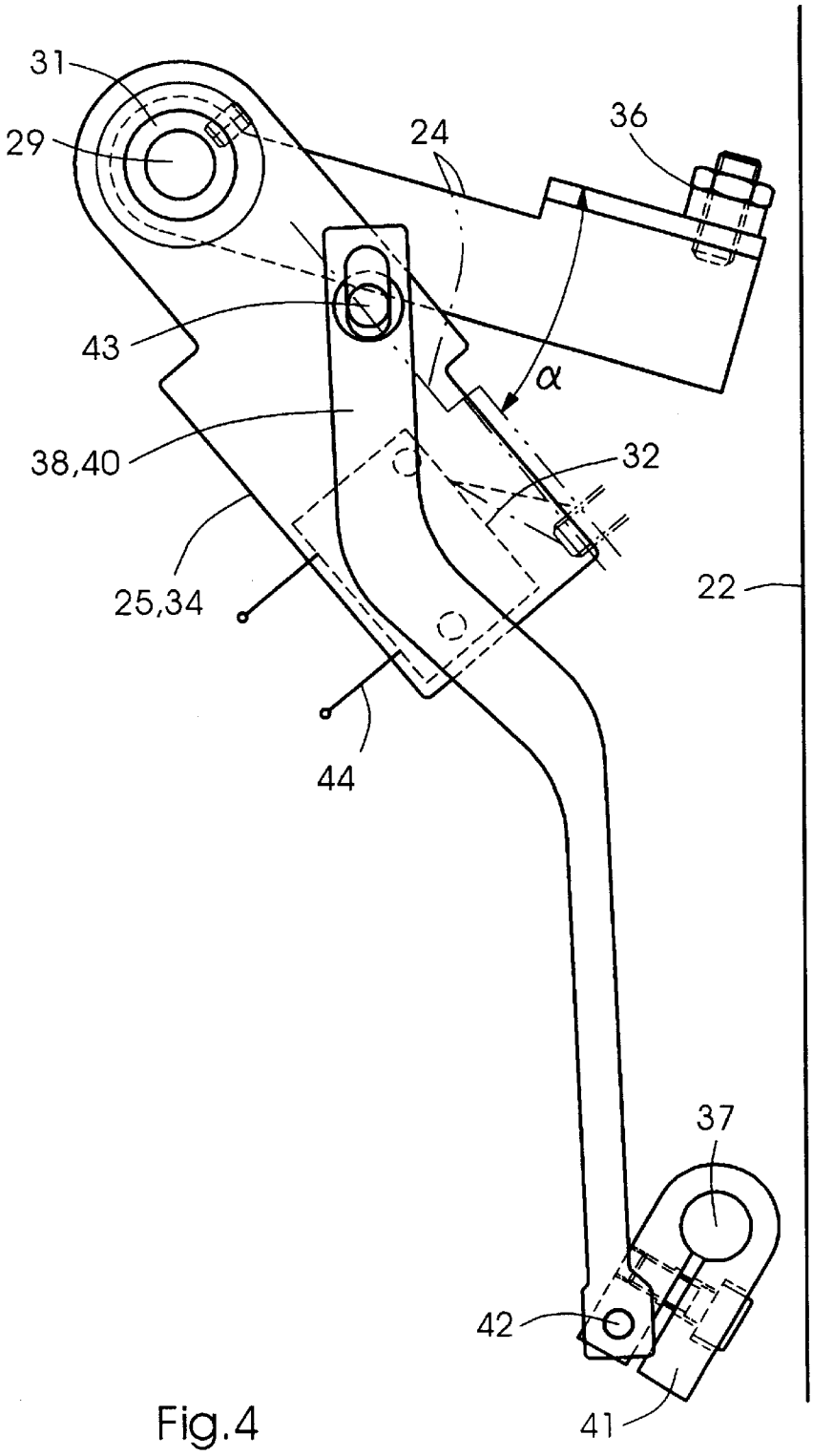
FIG. 4 is a side elevational view of FIG. 3 taken along the line IV—IV, in the direction of the arrows.

Applied to the second feeler 25 is an electric switch serving as a sensor 32, which is located in the circuit 44 feeding the motor 14. This is advantageous with regard to the very quick-reacting interruption of the circuit 44, which is interrupted by the sensor 32 when the outer diameter D of a roll 33 formed from the web band 11 as a supply roll on the unwinding roller, spindle or spool 12 falls below a specific value. The sensor 32 is fastened to a third lever arm 34 which, in turn, is applied to the shaft 29 and, together with the first lever arm 28 applied to the opposite end of the shaft 29, forms a rocker-like double lever. With regard to a reliable determination of the critical diameter D, it is advantageous for the first feeler 24, or more precisely, the first lever 27 thereof, to be held in permanent contact with the periphery of the roll 33 by a first spring bracing the feelers 24 and 25 against one another, in order to monitor the outer diameter D during the unwinding. At the same time, the reduction in the outer diameter D, as it is being monitored by the feelers 24 and 25, results in a pivoting of the first feeler 24 relative to the second feeler 25 about the first rotary joint 26, whereby an angle $\alpha$ (note FIG. 4) between the feelers 24 and 25 is varied, until the first feeler 24 triggers the sensor 32 at a specific magnitude of the angle $\alpha$.

As mentioned hereinbefore, the sensor 32 is constructed as an electric switch triggered by the first feeler 24 when the latter presses on the switch and thereby switches it over. The first feeler 24 actuates the sensor 32 by using a fourth lever arm 35 which is fastened to the hollow shaft 31, the fourth lever arm 35, together with the second lever arm 30 applied to the opposite end of the hollow shaft 31, forming a rocker-like double lever.

The feelers 24 and 25 have an adjusting device 36 assigned thereto, by which the critical diameter D can be precisely adjusted or set, i.e., by which it is possible to adjust or set the magnitude of the outer diameter D of the roll 33 at which the sensor 32 will be triggered. This is advantageous with regard to the selective or optional use of various types of web bands 11 in the winding device 7. Through the intermediary of the adjusting device 36, the winding device 7 can be adapted or matched to web bands 11 from different web-band suppliers and having different web-band thicknesses. When there is a specific number of remaining wound layers on the unwinding roller or spool 12, the number thereof being determined and being necessary in order to hold the end of the web band reliably, the critical diameter D results, which is proportional to the thickness of the web band that is used. The adjusting device 36 is applied to the first feeler 24 or, more precisely, to the fourth lever arm 35. The adjusting device 36 is constructed as an adjusting screw with a lock nut, which triggers the sensor 32 earlier or later depending upon whether it is screwed a greater or lesser distance out of the fourth lever arm 35.

In order to open and close the protective covering 22, the latter is pivotable about a third rotary joint 37. The first feeler 24 and the second feeler 25 are connected to the protective covering 22 via a mechanism 38, so that, by opening the protective covering 22, the feelers 24 and 25 are automatically displaced from the functional positions thereof counter to the action of a second spring, due to which the winding device 7 can be drawn out of the machine 1 without colliding with the feelers 24 and 25. With regard to relieving the load on the operator by minimizing the actions to be performed by the operator, it is advantageous that the feelers 24 and 25 be displaced automatically into the functional. positions by the closure of the protective covering 22.

The functional position of the first feeler 24 is the position thereof wherein it is in contact with the web band 11 and with the roll 33, respectively, in order to establish a relative position, with reference to the frame 23, of a peripheral surface U of the roll 33. As a result of the upward pivoting of the protective covering 22, as viewed in FIG. 3, the first feeler 24 is pivoted via the mechanism 38 from the contact. position into a spaced-apart position in relation to the roll 33. The functional position of the second feeler 25 is the position thereof wherein it is in contact with a part 39 of the device for determining a relative position, referred to the frame 23, of a center Z of the roll 33. The part 39 is disposed coaxially with the roll 33 and the unwinding roller, spindle or spool 12 thereof, and is rotatably mounted in the winding device 7.

The roll 33 and the part 39 are couplable to one another in a positive or form-locking manner, so that they are rotatable together. In this regard, it is noted that a form-locking connection is one which connects two elements together due to the shape of the elements themselves, as opposed to a force-locking connection, which locks the elements together by force external to the elements.

The part 39 is a disk-like entrainer or driver, which is provided with at least one needle and which is used for rotatingly driving the unwinding roller, spindle or spool 12 by the motor 14 when the web band 11 is being rewound from the winding roller or spool 12, which functions as an unwinding roller, spindle or spool at times during the rewinding, onto the unwinding roller, spindle or spool 13, which functions as a winding roller, spindle or spool at times during the rewinding. When the unwinding roller, spindle or spool 13 with the roll 33 is inserted into the winding device 7, the unwinding roller, spindle or spool 13 and the part 39 are connected to one another so as to rotate together. At the same time, the at least one needle sticks into the unwinding roller, spindle or spool 13, which can be a paperboard core, for example.

As a result of setting the second feeler 25 against the part 39, the position of the first feeler 24 relative to the unwinding spool, spindle or roller 23 is defined exactly. What is meant here is that relative position which the first feeler 24 assumes and wherein the first feeler 24 operates the sensor 32 when the roll 33 has reached the critical diameter D thereof. During unwinding, the second feeler 25 is held by the second spring permanently in contact with the part 39.

In a conceivable non-illustrated different embodiment, the part 39 is not the entrainer or driver but the unwinding roller, spool or spindle 12 itself, against which the second feeler 25 is set directly in this alternative embodiment. In this regard, the first feeler 24 determines or registers the respective current diameter D of the roll 33, and the second feeler 25 determines or registers the outer diameter D of the unwinding spindle, spool or roller 13 directly. This alternative embodiment is advantageous when the outer diameter of the unwinding spindle, spool or roller 13 turns out to be different from spindle to spindle because of wide dimensional tolerances or different spindle, roller or spool suppliers.

Both in the non-illustrated conceivable embodiment, as well as in the illustrated embodiment, reaching the end of the web band, which must not detach from the unwinding spindle, spool or roller 12 as a result of the unwinding while the machine 1 is running, is detected by the sensor 32 based upon the fact that the difference in diameter, which decreases progressively during the unwinding, between the diameter D of the roll 33 and the diameter D of the unwinding spindle, spool or roller 12 falls below a predefined limiting value when the critical diameter d of the roll 33 is reached.

The hereinaforementioned mechanism 38 is a coupling linkage having a rod 40 as coupler and, in specific terms, a flat four-bar mechanism. However, the mechanism 38 can also be constructed as a cam transmission. A driving swinging arm 41 of the mechanism 38 illustrated in FIG. 4 has an articulating connection with the rod 40 via a fourth rotary joint 42. The second feeler 25 has an articulating connection with the rod 40 via a fifth rotary joint 43, the latter including a slot formed in the rod 40, so as to serve simultaneously as a thrust joint for length-equalizing purposes. The second feeler 25 forms a driven swinging arm of the mechanism 38. The driving swinging arm 41 mounted in the third rotary joint 37 is arranged coaxially with the protective covering 22 and is connected to the latter for rotating therewith, so that, during the pivoting movement for opening and closing the protective covering 22, the driving swinging arm 41 is pivoted together with the covering 22. The pivoting movement thereof is transmitted, via the rod 40 attached to the fourth lever arm 35, to the feelers 24 and 25 in order to displace them into and out of the functional position.

The printing units 2, 4 and 5 are constructed in a manner corresponding to that of the aforedescribed printing unit 3, and the winding devices 6, 8, 9 and 10 are constructed in a manner corresponding to that of the aforedescribed winding device 7, and are thus likewise formed as cleaning devices.

As shown in FIG. 1, in order to change the web band 11, which has been soiled and used up by cleaning the cylinder 15, the winding device 7 is replaced by a winding device 10. The winding device 10 is a reserve device having a fresh web band. The spent web band 11 of the winding device 7 is replaced by a fresh web band 11 outside the machine 1, while the latter is operating. During the next machine stop necessitated by the operation of the machine 1, the winding device 6 can be removed from the machine 1, and the winding device 7, that has been suitably maintained in the interim, can be inserted into the machine 1 in place of the winding device 6.

This procedure can be continued, the winding device 6, following the maintenance thereof, replacing the winding device 9, and the latter, following the maintenance thereof, replacing the winding device 8, so that one winding device 6 to 10 is always kept in reserve.

The production dimensions of the printing units 2 to 5 and of the winding devices 6 to 10 which are relevant to the accuracy of the winding check are subject to production tolerances, which add up within the respective printing unit 2 to 5, within the winding device 6 to 10, and also during the combination of the respective winding device 6 to 10 with the respective printing unit 2 to 5, to form dimensional tolerance chains which are detrimental to the accuracy of the monitoring of the roll. Added thereto is possible bearing play in the guide on which the winding device 6 to 10 is inserted into the machine 1, which likewise has a negative influence upon the accuracy.

In the devices disclosed in the prior art, either wasting of a web band is tolerated, in order not to risk a machine accident resulting from a possible detachment of a web band from the unwinding spindle, spool or roller, or it is necessary for the pressman to perform appropriate adjustment work at each replacement of a device.

In the winding devices 6 to 10 illustrated and constructed in accordance with the invention, the inadequacies pertaining to the devices of the prior art are reliably avoided. Fastening the sensor 32 to the withdrawable winding device 7 and, in particular, to one of the feelers 24 or 25 of the latter, for example, as shown on the second feeler 25, in conjunction with presetting the first feeler 24 with the aid of the second feeler 25, is very effective with regard to eliminating the influence of the aforementioned dimensional tolerance chains and the aforementioned bearing play. The web band 11 is utilized in an optimum manner, without requiring repeated adjustment work for this purpose.

Of course, the aforedescribed winding check mechanism, with the feelers 24 and 25 and the sensor 32, can also be assigned to the winding spindle, spool or roller 13 instead of the unwinding spindle, spool or roller 12, if it is necessary to stop the winding of a web band as soon as a critical roll diameter D has been exceeded.

The terms "feeler 24" and "feeler 25" used in the foregoing description can readily be replaced by the terms "sensor 24" and "sensor 25".

Figure 5:
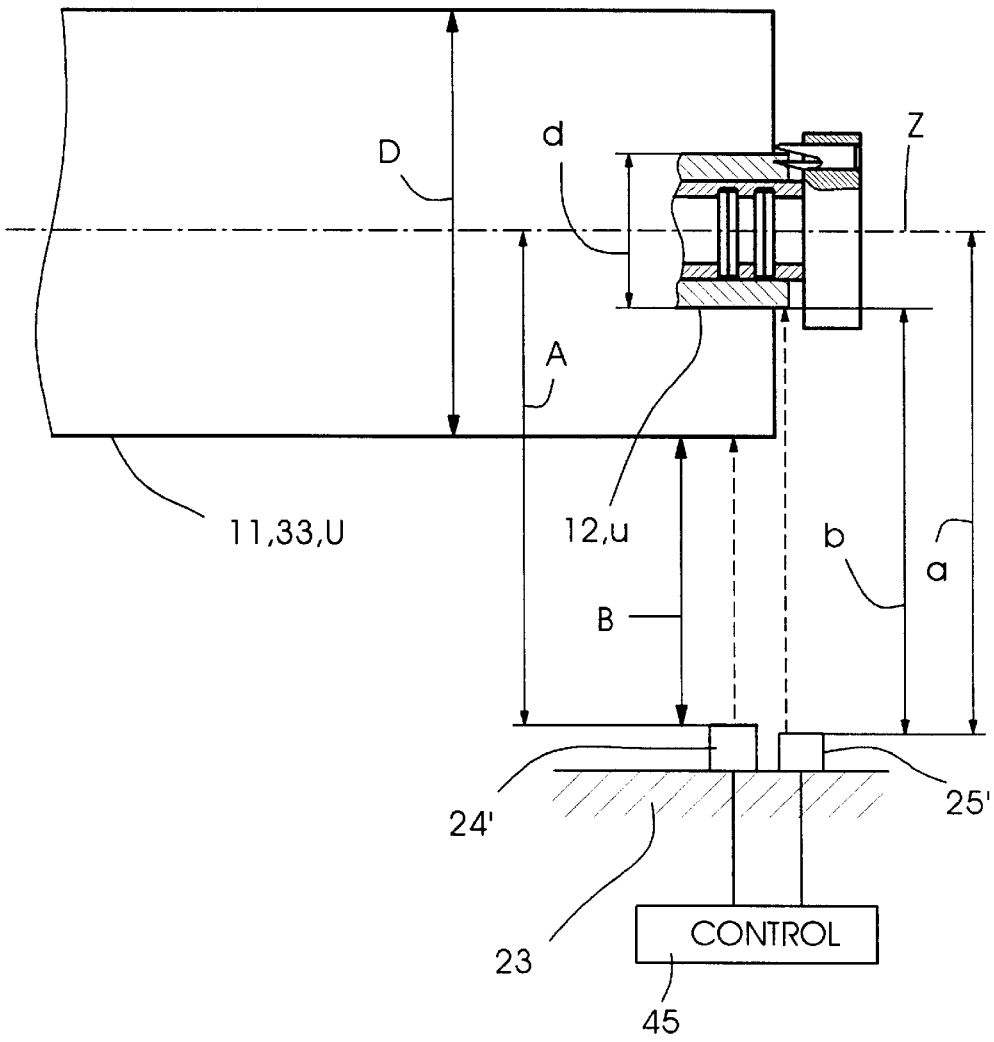
FIG. 5 is a highly diagrammatic and schematic view of a roll into which a web band has been wound, and illustrating a measurement principle for determining the length of web band wound into the roll.

FIG. 5 illustrates a measurement principle in which, instead of the feelers 24 and 25, two sensors 24' and 25' which act without contact are used. The first sensor 24' is fastened to the frame 23 and measures a distance B of the peripheral surface U of the roll 33 from the first sensor 24' and, therefore, indirectly a distance from the frame 23. The second sensor 25' is fastened to the frame 23, beside the first sensor 24' but offset in the parallel direction towards the center Z (axis of rotation), and measures a distance b of the peripheral surface u of the spindle 12 from the second sensor 25', and therefore indirectly a distance from the frame 23.

A distance A, the length of which is known, extending from the center Z to the first sensor 24', and a distance a, the length of which is likewise known, extending from the center Z to the second sensor 25', may deviate from the respective length thereof, depending upon the installation position of the roll 33. Because of the mutually identical measurement directions of the sensors 24' and 25', the magnitude and sign of the deviation of the distance A corresponds to the deviation of the distance a, so that these deviations are not included in the measured result.

A computer 45 linked to the sensors 24' and 25' as a component of an electronic control device forms the difference between the distances A and B and doubles this difference to form the diameter D of the roll 33. The computer 45 also forms the difference between the distances a and b and doubles this difference to form the diameter d of the spindle, spool or roller 12. The volume of the web band 11 wound onto the roller, spool or spindle 12 is calculated by the computer 45 from the difference between the diameters D and d. If the thickness of the web band 11 is stored in the computer 45, the computer 45 can use the difference in the diameters (D-d) to calculate the number of wound layers of the web band 11, and the length of the web band wound onto the spindle, spool or roller 12. It is therefore possible for the computer 45 to indicate this web length to the operator via a suitable indicator and to control the winding operation as a function of the difference in diameters.

For example, the computer 45 can interrupt the winding operation as soon as the difference in diameters falls below a critical dimension.

In order to advance the web band 11 a specific advance length, the roll 33 is rotated through a specific angle of rotation. The electronic control device comprising the computer 45 can so drive the motor 14 that the angle of rotation of the roll 33 is increased from winding operation to winding operation, in a manner proportional to the difference in diameters, so that during each winding operation, the web band is advanced or drawn off the spindle, spool or roller 12 by the same web-band length.

Depending upon the difference in diameters or upon a change in the difference in diameters per unit time, functions going beyond the winding in the machine that processes printing materials can be controlled. For example, an emergency stop of the machine can be triggered by the computer 45 if the difference in diameters decreases an excessively large amount within a specific time interval, as may be the case when the web band 11 is drawn into a printing unit, or in the event of other faults or disruptions.

If the distance of the center Z from the frame 23 is to be determined or registered indirectly by the second sensor 25', then, according to a different embodiment which is not specifically illustrated, the sensor 25' can be directed at the part 39.

I claim:

1. A method of winding a web band in a machine for processing printing materials, including controlling the winding as a function of a diameter of a roll formed by the web band, as the diameter changes during the winding, which comprises:

determining, with a first feeler a position of a peripheral surface of the roll;

determining, with a second feeler a position of one of a center of the roll and of a peripheral surface of a spindle carrying the roll; and monitoring a mutually relative position of the first feeler and of the second feeler using a sensor for monitoring mutually relative angular position.

2. The winding device according to claim 1, wherein said sensor is applied to one of said feelers.

3. The method according to claim 1, wherein the position of a peripheral surface of the roll is determined relative to a frame of the machine, and the position of one of the center of the roll and of the peripheral surface of the spindle carrying the roll is determined relative to the frame of the machine.

4. The method according to claim 1, wherein the position of a peripheral surface of the roll is determined by the first feeler fastened to a frame of the machine, and the position of one of the center of the roll and of the peripheral surface of the spindle is determined by the second feeler fastened to the frame of the machine.

5. The method according to claim 1, wherein the first feeler rests on the roll formed by the web band, and the method further comprises monitoring the diameter of the roll formed by the web band, as the diameter changes during the winding, and interrupting the winding when the roll has reached a critical diameter.

6. A winding device for a machine for processing printing materials, comprising:

a web band windable into a roll;

a first feeler for monitoring a diameter of the roll being wound as the diameter changes during the winding;

a second feeler for monitoring a position of one of a center of the roll and of a peripheral surface of a spindle carrying the roll; and a sensor assigned to said feelers for monitoring the mutually relative positions thereof.

7. The winding device according to claim 6, wherein said first feeler and said second feeler are pivotable coaxially with one another.

8. The winding device according to claim 6, wherein said second feeler is mounted affixed to a frame of the machine, and said second feeler remains mounted affixed to the frame during removal of the web band and spindle.

9. The winding device according to claim 6, including a protective covering of the machine coupled with said first feeler via a mechanism.

10. The winding device according to claim 6, wherein said web band is a cleaning cloth.

11. A machine for processing printing materials having at least one winding device according to claim 6.

12. A printing press having at least one winding device according to claim 6.

13. The winding device according to claim 6, wherein said first feeler is mounted affixed to a frame of the machine, and said first feeler remains mounted affixed to the frame during removal of the web band and spindle.

14. A winding device for a machine for processing printing materials, comprising:

a web band to be wound onto a roll; one feeler for monitoring a diameter of the roll being wound as the diameter changes during the winding, said one feeler being mounted to a machine frame;

another feeler mounted to the machine frame to be pivotable coaxially with said one feeler; and a sensor associated with said one feeler and said other feeler for monitoring relative positions of said one feeler relative to said other feeler.

15. The winding device according to claim 14, further comprising a protective covering of the machine coupled with said one feeler via a mechanism.

* * * * *